US009592895B2

(12) United States Patent
Yu et al.

(10) Patent No.: US 9,592,895 B2
(45) Date of Patent: Mar. 14, 2017

(54) UNDERWATER DOCKING SYSTEM AND DOCKING METHOD USING THE SAME

(71) Applicant: Postech Academy-Industry Foundation, Gyeongsangbuk-do (KR)

(72) Inventors: Son-Cheol Yu, Gyeongsangbuk-do (KR); Jeong Hwe Gu, Daegu (KR); Han Gil Joe, Gyeongsangnam-do (KR); Hyeon Woo Cho, Gyeongsangbuk-do (KR); Ju Hyun Pyo, Gyeongsangnam-do (KR)

(73) Assignee: Postech Academy-Industry Foundation, Gyeongsangbuk-do (KR)

( * ) Notice: Subject to any disclaimer, the term of this patent is extended or adjusted under 35 U.S.C. 154(b) by 0 days.

(21) Appl. No.: 14/717,126

(22) Filed: May 20, 2015

(65) Prior Publication Data

US 2015/0376851 A1 Dec. 31, 2015

(30) Foreign Application Priority Data

Jun. 19, 2014 (KR) ..... 10-2014-0074920

(51) Int. Cl.
*B63C 11/48* (2006.01)
*B63G 8/00* (2006.01)

(52) U.S. Cl.
CPC ..... *B63G 8/001* (2013.01); *B63G 2008/008* (2013.01)

(58) Field of Classification Search
CPC ..... B63B 2027/165
USPC ..... 405/188, 189, 190, 191; 114/242, 244, 114/248, 249, 253, 258
See application file for complete search history.

(56) References Cited

U.S. PATENT DOCUMENTS

| | | | | |
|---|---|---|---|---|
| 6,223,675 | B1 * | 5/2001 | Watt | B63G 8/001 114/312 |
| 6,390,012 | B1 | 5/2002 | Watt et al. | |
| 6,416,369 | B1 * | 7/2002 | Coakley | B63B 21/56 114/242 |
| 7,775,174 | B1 * | 8/2010 | Humphreys | B63B 21/66 114/244 |
| 2012/0167814 | A1 * | 7/2012 | Kalwa | B63G 8/001 114/322 |

(Continued)

FOREIGN PATENT DOCUMENTS

| | | |
|---|---|---|
| JP | 2001-055193 | 2/2001 |
| KR | 100831646 B1 | 5/2008 |
| KR | 101138859 B1 | 5/2012 |

*Primary Examiner* — Sean Andrish
(74) *Attorney, Agent, or Firm* — Reinhart Boerner Van Deuren P.C.

(57) ABSTRACT

Disclosed herein are an underwater docking system and a docking method using the system. An exemplary embodiment of the present invention relates to a system for docking a target body on a docking station under water, the system comprising: a guide unit provided to the docking station to transmit at least one guide signal to the target body; an agent unit connected to the docking station by a smart cable and disposed at a position spaced apart from the docking station so that the agent unit is moored under the water in a direction corresponding to a tidal current; and the target body configured to be guided toward the agent unit by the guide signal and then connected to a portion of the agent unit.

22 Claims, 9 Drawing Sheets

(56) References Cited

U.S. PATENT DOCUMENTS

2013/0269585 A1* 10/2013 Kim ..... B63G 8/001
114/331

* cited by examiner

UNDERWATER DOCKING SYSTEM AND DOCKING METHOD USING THE SAME

CROSS REFERENCE TO RELATED APPLICATION

This application claims priority from and the benefit of Korean Patent Application No. 10-2014-0074920, filed on Jun. 19, 2014, which is hereby incorporated by reference for all purposes as if fully set forth herein.

BACKGROUND OF THE INVENTION

Field of the Invention

Exemplary embodiments of the present invention relate to an underwater docking system for docking a target body on a station under water, and a docking method using the system.

Description of the Related Art

Unmanned underwater vehicles are increasingly used for surveying the sea floor and marine ecological environments, and for surveying characteristics such as water temperature and salinity in areas that exceed the limit to which humans can physiologically dive. Such unmanned underwater vehicles may further be used for work in contaminated areas, or in detecting explosives such as mines and removing them, or in military operations such as underwater reconnaissance. Research on such unmanned underwater vehicles is also increasingly being conducted.

Such unmanned underwater vehicles include autonomous underwater vehicles (AUV), remotely operated vehicles (ROV), and underwater robots, all of which can be autonomously operated under water. It is necessary, however, for unmanned underwater vehicles to be periodically retrieved from the sea for maintenance, such as charging or replacement of a battery after underwater operations.

A lot of time and cost are required to retrieve an unmanned underwater vehicle from the sea. As a method of reducing such time and cost, it is preferable that the unmanned underwater vehicle be docked on an underwater docking station without retrieval onto the ground, and then battery charge and data transmission and reception are conducted in real time with the vehicle remaining under the water. However, it is very difficult to conduct a series of operations including guiding the unmanned underwater vehicle toward the stationary docking station under the water and precisely and reliably docking the vehicle on the stationary docking station. This is because the range of vision underwater is comparatively short, a typical radio communication method cannot be used under the water, and the position of the unmanned underwater vehicle varies due to the tidal current.

SUMMARY OF THE INVENTION

Exemplary embodiments of the present invention provide an underwater docking system that can reliably dock a target body such as an unmanned underwater vehicle on a station, and a docking method using the underwater docking system.

Additional features of the invention will be set forth in the description which follows, and in part will be apparent from the description, or may be learned by practice of the invention.

An aspect of the present invention provides a system for docking a target body on a docking station under water, the system comprising: a guide unit provided to the docking station to transmit at least one guide signal to the target body; an agent unit connected to the docking station by a smart cable and disposed at a position spaced apart from the docking station so that the agent unit is moored under the water in a direction corresponding to a tidal current; and the target body configured to be guided toward the agent unit by the guide signal and then connected to a portion of the agent unit.

The guide unit comprises an ultrasonic beacon generating an ultrasonic wave toward the target body, when the target body is disposed within a long distance from the docking station; and an imaging sonar capturing an image of the target body, when the target body is disposed within a short distance from the docking station.

The smart cable is connected at a first end thereof to the agent unit and connected at a second end thereof to a winch of the docking station so that a distance between the docking station and the agent unit is varied by operation of the winch.

The agent unit comprises a main body provided with a connection port on which a connector of the target body is docked; at least one rudder provided on a circumferential surface of the main body; and at least a propeller provided on the main body so that a position at which the agent unit is moored can be adjusted.

The main body and the target body respectively comprise communication units corresponding to each other, the communication units sending and receiving a control signal transmitted by the smart cable so that a position of the target body is adjusted.

The imaging sonar uses a captured image to check a distance between the agent unit and the target body and transmits a control command to the agent unit in real time.

The other aspect of the present invention provides a system for docking a target body on a docking station under water, the system comprising: a docking station; an agent unit connected to the docking station by a cable and disposed at a position spaced apart from the docking station so that the agent unit is moored under the water in a direction corresponding to a tidal current; a guide unit provided to the docking station to transmit a guide signal to the target body; and the target body configured to be guided toward the agent unit by the guide signal and then connected to the agent unit.

The guide unit comprises an ultrasonic beacon generating ultrasonic waves toward the target body when the target body is disposed within a long distance, and thus guiding the target body into a medium distance; an imaging sonar measuring the distance between the agent unit and the target body guided into the medium distance and then guiding the target body from the medium distance into a short distance; and an underwater camera provided on the target body to check the position of the agent unit, when the target body is guided to the short distance, for the target body to be guided to the agent unit.

The ultrasonic beacon is provided on the agent unit, the imaging sonar is provided on the docking station, and the underwater camera is provided on the target body.

The cable is a smart cable, the smart cable is connected at a first end thereof to the agent unit and connected at a second end thereof to a winch of the docking station so that a distance between the docking station and the agent unit is varied by operation of the winch.

The agent unit comprises a main body provided with a connection port on which a connector of the target body is docked; and at least one rudder provided on a circumferential surface of the main body.

The main body is provided with at least a propeller so that a position at which the agent unit is moored can be adjusted.

The main body and the target body respectively comprise communication units corresponding to each other, the communication units sending and receiving a control signal transmitted by the smart cable so that a position of the target body is adjusted.

The imaging sonar uses a captured image to check a distance between the agent unit and the target body and transmits a control command to the agent unit by the smart cable.

The docking station comprises a support fixed at a lower end thereof in the water; and a rotatable body provided on an upper portion of the support so as to be rotatable relative to the support.

Another aspect of the present invention provides a method of docking a target body on a docking station under water, the method comprising: mooring an agent unit for docking the target body on the docking station by a cable and disposed at a position spaced apart from the docking station in a direction of a tidal current, transmitting a guide signal from a guide unit provided in the docking station to the target body; and connecting the target body guided toward the agent unit by the guide signal to the agent unit.

The guide unit comprises an ultrasonic beacon generating an ultrasonic wave, and an imaging sonar capturing an image, an underwater camera checking the position of the agent unit wherein the target body is guided toward the docking station by the ultrasonic wave when the target body is disposed within a long distance from the docking station, the target body is guided toward the agent unit using an image captured by the imaging sonar when the target body is disposed within a medium distance from the docking station, and the target body is guided toward the agent unit using the underwater camera when the target body is disposed within a short distance from the docking station.

After a distance between the agent unit and the target body is checked by the image captured by the imaging sonar, a control command for aligning the target body with the agent unit is transmitted to the agent unit by the smart cable.

A position at which the agent unit is moored is adjusted in such a way that a length of the smart cable connected at a first end thereof to the agent unit and connected at a second end thereof to a winch of the docking station is varied by operation of the winch.

The agent unit comprises a main body provided with a connection port on which a connector of the target body is docked, and at least one propeller provided on a circumferential surface of the main body, wherein a position at which the agent unit is moored is adjusted by operation of the propeller.

The agent unit and the target body respectively comprise communication units corresponding to each other, the communication units sending and receiving a control signal and an information regarding the position of the agent unit captured by an underwater camera so that a position of the target body is adjusted.

The docking station comprises a support fixed at a lower end thereof in the water, and a rotatable body rotatably coupled to the support, wherein the rotatable body is rotated such that the agent unit is aligned with the direction of the tidal current.

In an underwater docking system and a docking method using the system according to an embodiment of the present invention, a target body is docked in such a way that it is connected to an agent unit coupled to a station by a cable and then towed to the station by the agent unit, whereby the target body can be more reliably and effectively retrieved.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

FIGS. 3A through 3E are views showing a process of retrieving a target body in the underwater docking system according to the exemplary embodiment of the present invention, in which: FIG. 3A illustrates an initial stage; FIG. 3B is a view showing the moored agent unit; FIG. 3C is a view showing a process of guiding the target body toward the station when the target body is disposed within a long distance from the agent unit; FIG. 3D is a view showing a process of guiding the target body toward the station when the target body is disposed within a short distance from the agent unit; and FIG. 3E is a view showing the target body connected to the agent unit;

FIGS. 6A through 6E are views showing a process of retrieving a target body in the underwater docking system of FIG. 4, in which: FIG. 6A illustrates an initial stage; FIG. 6B is a view showing the moored agent unit; FIG. 6C is a view showing a process of guiding the target body toward the station when the target body is disposed within a long distance from the agent unit; FIG. 6D is a view showing a process of guiding the target body toward the station using the imaging sonar installed at the docking station when the target body is disposed within a medium distance from the agent unit; and FIG. 6E is a view showing a process of guiding the target body toward the agent unit using the underwater camera installed at the target body when the target body is disposed within a short distance from the agent unit;

DESCRIPTION OF THE PREFERRED EMBODIMENTS

Figure 1:
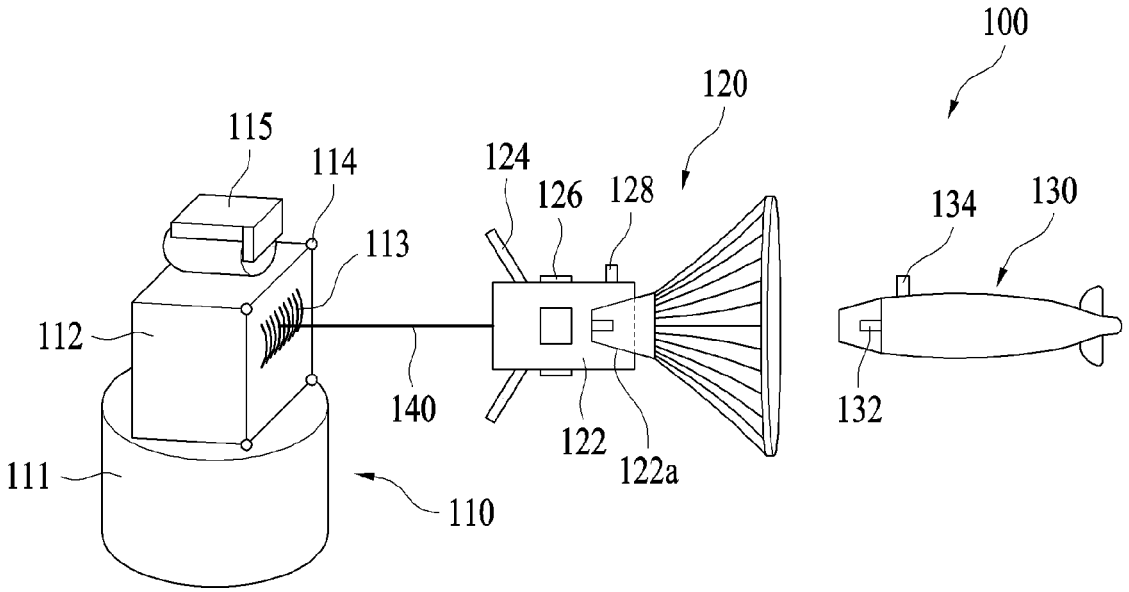
FIG. 1 is a schematic view illustrating an underwater docking system according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

An underwater docking system and method according to an exemplary embodiment of the present invention will be described in detail with reference to the attached drawings.

First Embodiment

Referring to FIG. 1, the underwater docking system 100 according to the exemplary embodiment of the present invention includes a docking station 110, an agent unit 120 and a target body 130.

The docking station 110 provides a position to which the target body 130 is ultimately guided.

A winch 113 for use in winding or unwinding a cable 140 connected to the agent unit 120 is provided at a portion of the docking station 110. To conduct the operation of docking the target body 130, the winch 113 is operated to unwind the cable 140 that has been wound around a drum of the winch 113. Then, the agent unit 120 is moored under the water at a position spaced apart from the docking station 110 by a predetermined distance.

After the operation of docking the target body 130 to the agent unit 120 has been completed, the winch 113 is operated to wind the cable 130 around the drum and tow the agent unit 120 and the target body 130 toward the docking station 110, thus operating data transmission and reception and charging a battery underwater.

Figure 3A:
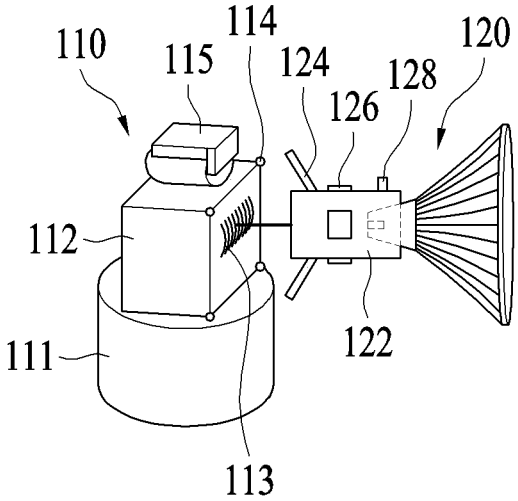
Figure 3B:
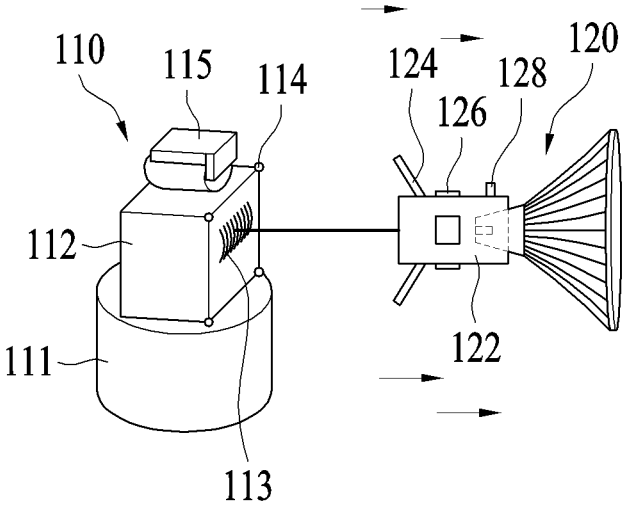

Here, the docking station 110 is configured such that the winch 113 around which the cable 140 is wound can be controlled in response to the direction of the tidal current, whereby the agent unit 120 connected to the end of the cable 140 can be reliably moored in a direction corresponding to the tidal current (illustrated by unlabeled arrows in FIG. 3B).

To achieve this, the docking station 110 includes a support 111 fastened at a lower end thereof to the seafloor, and a rotatable body 112 disposed on an upper portion of the support 111 and rotatably coupled to the support 111.

Figure 2:
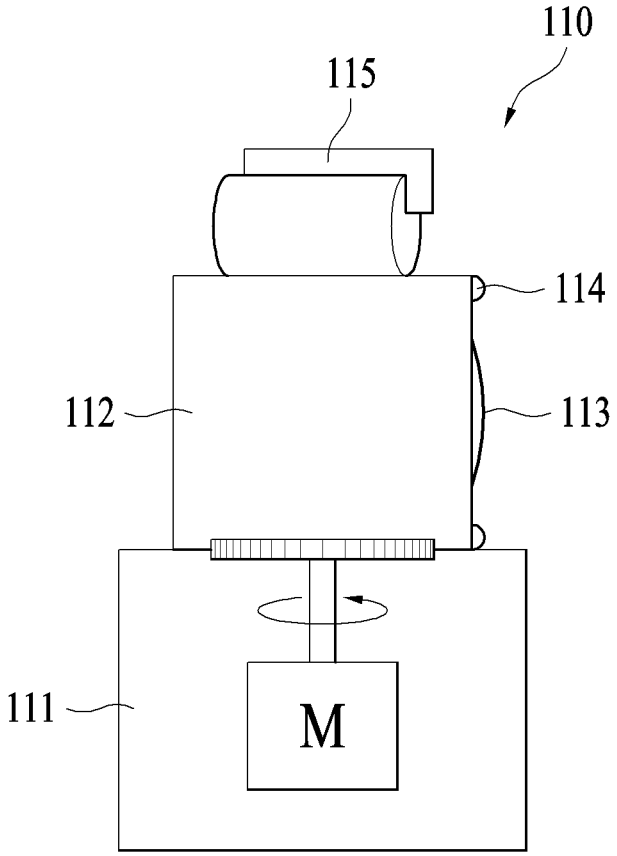
FIG. 2 is a schematic view illustrating a station according to the exemplary embodiment of the present invention.

The rotatable coupling of the rotatable body 112 to the support 111 can be embodied in such a way that the rotatable body 112 is connected to the support 111 by an appropriate number of motors and gear coupling (illustrated schematically in FIG. 2 by motor M). Furthermore, the winch 113 also uses an appropriate number of motors and gear coupling to rotate the drum in the normal or reverse direction and wind or unwind the cable 140 around or from the drum. The construction of the above-mentioned rotatable coupling structure is well known, so further explanation will be omitted.

The docking station 110 includes a guide unit that transmits a guide signal to guide the target body 130 to the docking station 110 or the agent unit 120.

The guide unit includes at least one ultrasonic beacon 114 that generates ultrasonic waves toward the target body 130 so that the target body 130 is guided from a long distance to a short distance about the agent unit. And the guide unit includes at least an optical instrument that captures an image of the target body 130 guided into the short distance for use in guiding the target body 130 toward the agent unit 120. The long distance may be from 30 m to 1500 m and the short distance may be from 1 m to 30 m. However, it is understood that "the long distance" and "the short distance" is relative, "the long distance" and "the short distance" is not limited to a specific distance. An imaging sonar 115, which is well known, may be used as the acoustic instrument.

That is, in this embodiment of the present invention, different kinds of guide methods are used depending on the distance between the docking station 110 and the target body 130 so that the docking operation can be more reliably conducted.

Figure 3C:
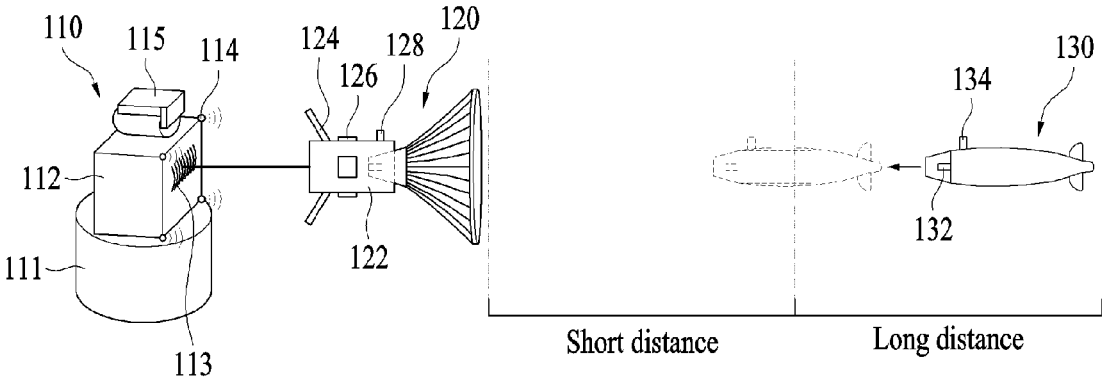
Figure 3D:
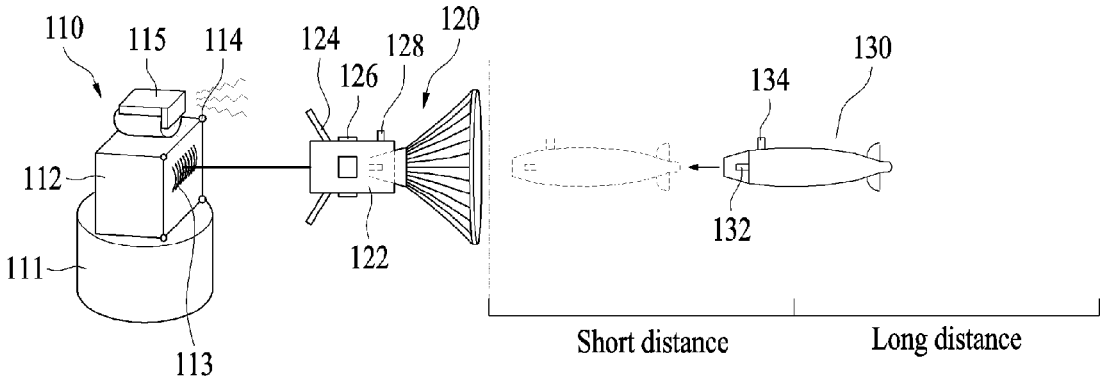
Figure 3E:
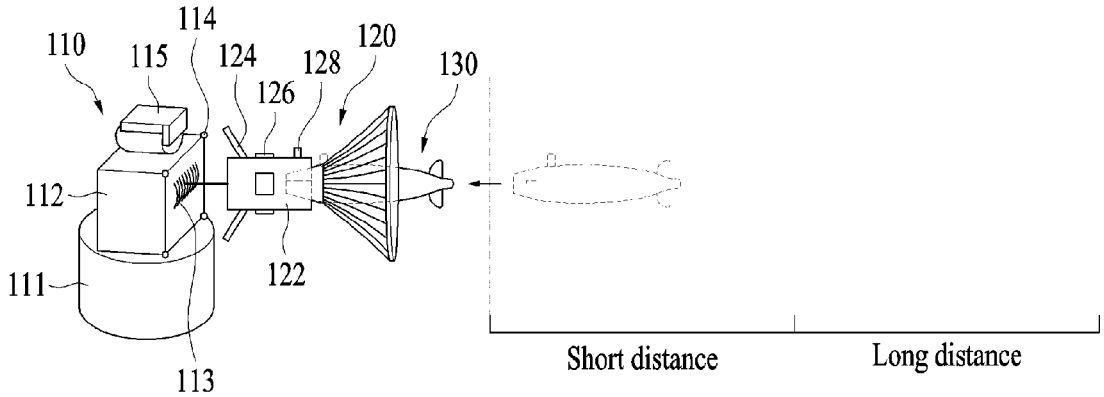

Referring to FIGS. 3C and 3D, when the target body 130 is within a long distance from the agent unit 120, the ultrasonic beacon 114 generates ultrasonic waves to roughly guide the target body 130 into a short distance from the docking station 110. After the target body 130 is guided into the short distance from the docking station 110, the imaging sonar 115 captures images to measure distances between the docking station 110, the agent unit 120 and the target body 130 and then transmits a control command to the agent unit 120 to guide the target body 130 to the agent unit 120.

As such, the underwater docking system 100 according to the exemplary embodiment of the present invention uses different kinds of guide methods depending on the distance between the target body 130 and the docking station 110 so that the docking operation can be more reliably and precisely conducted.

The ultrasonic beacon 114 and the imaging sonar 115 are provided on the rotatable body 112 so that the imaging sonar 115 can be always oriented to face the target body 130 by the rotation of the rotatable body 112 relative to the support 111.

After guiding the target body 130 toward the agent unit 120, the agent unit 120 is directly connected with the target body 130. The agent unit 120 is connected to the docking station 110 by the cable 140, whereby after being spaced apart from the docking station 110 by a predetermined distance by the operation of the winch 113, the agent unit 120 can be moored under the water in the direction corresponding to the tidal current.

Unlike the conventional technique in which the target body 130 is directly docked on the docking station 110, the underwater system 100 according to the exemplary embodiment of the present invention is configured such that the target body 130 is connected to the separate agent unit 120, which is connected to the docking station 110 by the cable 140 and thus can be moored under the water in the direction corresponding to the tidal current. Therefore, even when a comparatively small docking station 110 and agent unit 120 are used, the influence of the tidal current on the docking operation can be minimized, whereby the docking operation can be conducted more reliably and precisely.

The cable 140 comprises a well-known smart cable to make it possible to transmit data or control signals from the docking station 110 to the agent unit 120.

The agent unit 120 includes a main body 122 having a connection port 122*a* on which a connector 132 of the target body 130 is docked, and at least one rudder 124 that is provided on the circumferential surface of the main body 122.

Thus, when the agent unit 120 is moored by the cable 140 under the water, the agent unit 120 can be oriented in the direction aligned with the tidal current by the rudders 124.

Furthermore, at least one propeller is provided in the main body 122 so that the position of the agent unit 120 that is being moored can be adjusted, whereby the agent unit 120 can overcome hindrance of the tidal current during the docking operation.

Consequently, although the target body 130 that is docked on the agent unit 120 has a torpedo shape that is comparatively long, the target body 130 can more rapidly and precisely approach the agent unit 120 without detouring around a movement path because the location and the direction of the main body 122 can be adjusted by the propeller 126.

Here, the propeller 126 may be used well known jet propeller or screw propeller.

Communication units 128 and 134 corresponding to each other are respectively provided in the main body 122 and the target body 130 so that the agent unit 120 and the target body 130 can directly communicate with each other.

That is, the first communication unit 128 is provided in the main body 122 and the second communication unit 134 corresponding to the first communication unit 128 is provided in the target body 130. After the target body 130 has been guided to a position close to the agent unit 120 by the imaging sonar 115, the agent unit 120 and the target body 130 use the communication units 128 and 134 to send and receive information about positions relative to each other. Thus, position control and direction control can be precisely conducted, whereby the docking operation can be reliably performed.

Moreover, the communication units 128 and 134 function to transmit data and a control signal, which is transmitted from the docking station 110 by the cable 140, to the target body 130 via the agent unit 120.

The target body 130 autonomously moves under the water to collect a variety of information in response to a given assignment. The target body 130 may be an unmanned underwater vehicle or robot such as an autonomous underwater vehicle (AUV) or a remotely operated vehicle (ROV).

After collecting a variety of underwater information, the target body 130 is periodically guided to the agent unit 120 for required maintenance work such as charge of an internal battery. Here, the target body 130 uses the connector 132 to dock on the connection port 122*a* of the agent unit 120. After the docking operation has been completed, the target body 130 may transmit the data to the docking station 110.

The target body 130 may include a separate underwater acoustic sensor (not shown) provided to receive a signal transmitted from the ultrasonic beacon 114, and an underwater camera (not shown) provided to capture an image of the agent unit 120 or the docking station 110 within the short distance.

Such construction of the target body 130 is well known. Therefore, further explanation is deemed unnecessary.

Meanwhile, as described above, the target body 130 has the second communication unit 134 at a portion thereof to transmit or receive data or a control command to or from the first communication unit 128 of the agent unit 120. Data or a control command transmitted from or to the first communication unit 128 may include information obtained from the underwater acoustic sensor and the underwater camera that are provided in the target body 130.

Each of the first communication unit 128 and the second communication unit 134 is an LED (Light Emitting Diode) light source so that data or a signal can be sent or received through communication using an optical link. For example, switching on and off the LED light source may be used to transmit required information under the water.

Hereinafter, a method of docking the target body 130 using the underwater agent unit according to an exemplary embodiment of the present invention will be described in detail with reference to FIGS. 3A through 4.

At step S1, the rotatable body 112 with the cable 140 wound around the winch 113 is rotated relative to the support 111 by a predetermined angle so that the agent unit 120 can be located on the tidal path. The winch 113 is thereafter operated to unwind the cable 140 and moor the agent unit 120 at a position spaced apart from the docking station 110 by a predetermined distance. The agent unit 120 is moored in the same direction of that of the tidal current. The at least one rudder 124 provided on the main body 122 is used to maintain the orientation of the agent unit 120.

Subsequently, at step S21, the ultrasonic beacon 114 generates an ultrasonic wave to the target body 130 so as to guide the target body 130 toward the docking station 110 until the target body 130 moves into the short distance of the docking station 110.

After the target body 130 has moved into the short distance and thus has approached the docking station 110 or the agent unit 120, at step S22, the distance between the agent unit 120 and the target body 130 is checked using an image captured by the imaging sonar 115, and a control command is transmitted to the agent unit 120 by the cable 140 so that the target body 130 is guided to a position very close to the agent unit 120 in alignment with each other of the agent unit 120 and the target body 130.

During the above operation, the position of the agent unit 120 is adjusted in such a way that the at least one propeller 126 provided on the main body 122 is used to overcome the tidal force.

Meanwhile, during the docking operation, the step S21 of using the ultrasonic beacon 114 to guide the target body 130 can be omitted if the target body 130 is near to the agent unit 120.

If the target body 130 very closely approaches the agent unit 120, at step S23, the first communication unit 128 and the second communication unit 134 transmit and receive information about the relative positions via communication so that the target body 130 and the agent unit 120 are aligned with each other. In the meantime, at step S3, the connector 132 of the target body 130 is precisely connected to the connection port 122*a* of the agent unit 120.

Finally, at step S4, after the operation of docking the target body 130 on the agent unit 120 has been completed, the winch 113 is operated to wind the cable 140 around the drum. Consequently, the target body 130 docked on the agent unit 120 is retrieved to the docking station 110.

Second Embodiment

Figure 4:
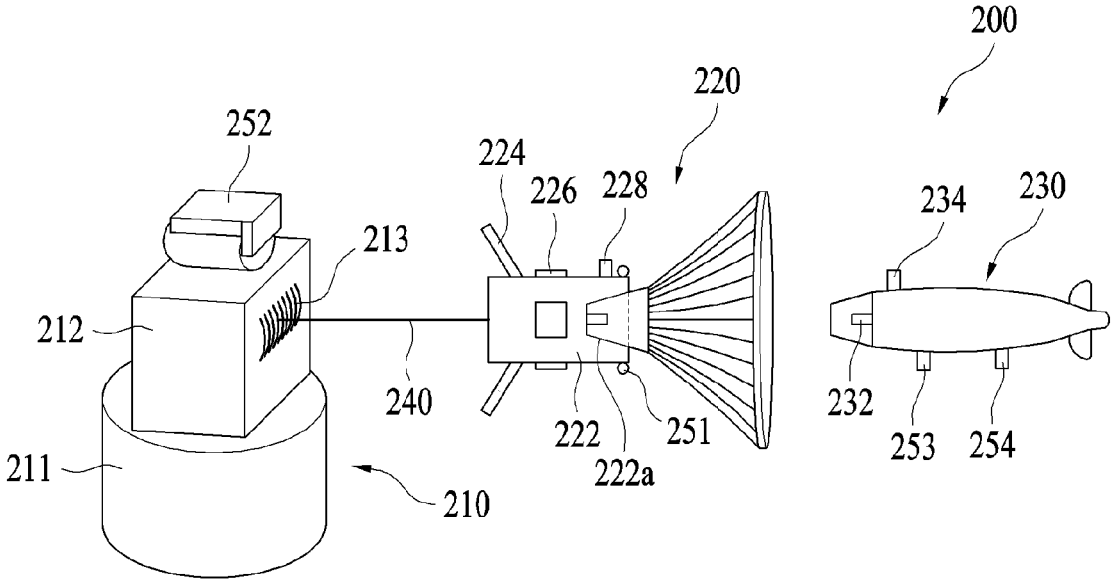
FIG. 4 is a schematic view illustrating an underwater docking system according to the other exemplary embodiment of the present invention.
Figure 5:
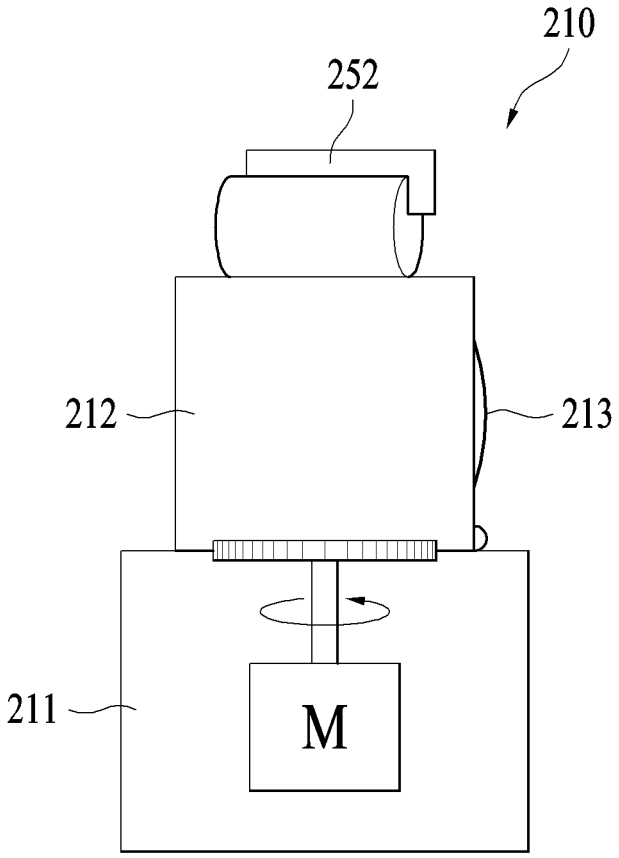
FIG. 5 is a schematic view illustrating a station of FIG. 4.

Referring to FIG. 4, an underwater docking system 200 according to an exemplary embodiment of the present invention includes a docking station 210, an agent unit 220, and a target body 230.

The docking station 210 provides a position to which the target body 230 is ultimately guided.

A winch 213 for use in winding or unwinding a cable 240 connected to the agent unit 220 is provided at a portion of the docking station 210. To conduct the operation of docking the target body 230, the winch 213 is operated to unwind the cable 240 that has been wound around a drum of the winch 213. Then, the agent unit 220 is moored under the water at a position spaced apart from the docking station 210 by a predetermined distance.

After the operation of docking the target body 230 to the agent unit 220 has been completed, the winch 213 is operated to wind the cable 240 around the drum and tow the agent unit 220 and the target body 230 toward the docking station 210, thus making it possible to conduct battery charging, and data transmission and reception operation in real time.

Here, the docking station 210 is configured such that the winch 213 around which the cable 240 is wound can be controlled in response to the direction of the tidal current (illustrated by unlabeled arrows in FIG. 6B), whereby the agent unit 220 connected to the end of the cable 240 can be reliably moored in a direction corresponding to the tidal current. Furthermore, the cable 240 can be varied in length depending on the intensity of the tidal current and the position of the agent unit 220.

To achieve this, the docking station 210 includes a support 211 fastened at a lower end thereof to the seafloor, and a rotatable body 212 disposed on an upper portion of the support 211 so as to be rotatable relative to the support 211.

The rotatable coupling of the rotatable body 212 to the support 211 can be embodied in such a way that the rotatable body 212 is connected to the support 211 by an appropriate number of motors and gear coupling. Furthermore, the winch 213 also uses an appropriate number of motors and gear coupling to rotate the drum in the normal or reverse direction and wind or unwind the cable 240 around or from the drum. The above-mentioned rotatable coupling configuration is well known, so further explanation will be omitted.

The stationary docking station 210, the agent unit 220, and the target body 230 each include a guide unit that transmits a guide signal to guide the target body 230 to the docking station 210 or the agent unit 220.

The guide unit includes: at least one ultrasonic beacon 251 that generates ultrasonic waves toward the target body 230 when the target body 230 is disposed within a first range at a position spaced apart from the docking station 210 by a predetermined distance, and thus guides the target body 230 into a second range to a position spaced apart from the docking station 210 by a predetermined distance; an imaging sonar that measures in real time the distance between the agent unit 220 and the target body 230 that has been guided into the second range and then guides the target body 230 from the second range into a third range to a position spaced apart from the docking station 210 by a distance; and an underwater camera 253 that is provided on the target body 230 and checks the position of the agent unit 220, when the target body 230 is guided to a position corresponding to the third range, so as to enable the target body 230 to be guided to the agent unit 220. The distance from the docking station 210 within the first range is a distance corresponding to a long distance and may be a distance ranging from 30 m to 1500 m. The distance from the docking station 210 within the second range is a distance corresponding to a medium distance and may be a distance ranging from 10 m to 30 m. The distance from the docking station 210 within the third range is a distance corresponding to a short distance and may be a distance ranging from 1 m to 10 m. However, the distances from the docking station 210 within the first range, the second range, or the third range must be understood as indicating being merely relatively distance or close, and are not limited to the above-mentioned distances.

The ultrasonic beacon 251 is provided on the agent unit 220, the imaging sonar 252 is provided on the docking station 210, and the underwater camera 253 is provided on the target body 230. The target body 230 is provided with a hydrophone 254 for receiving a guide signal generated from the ultrasonic beacon 251.

Figure 6A:
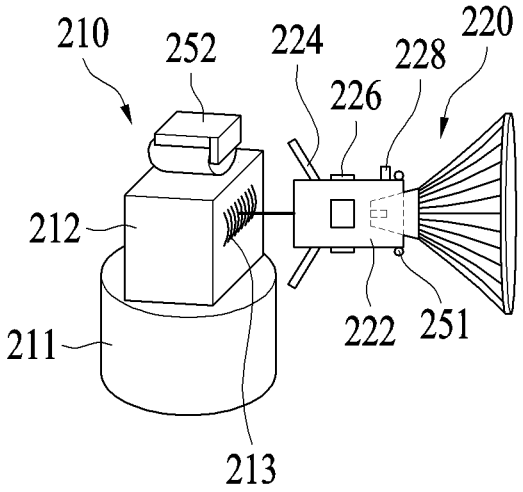
Figure 6B:
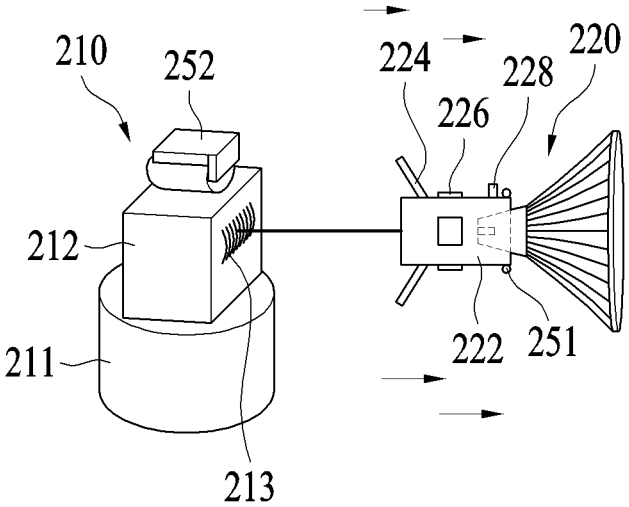
Figure 6C:
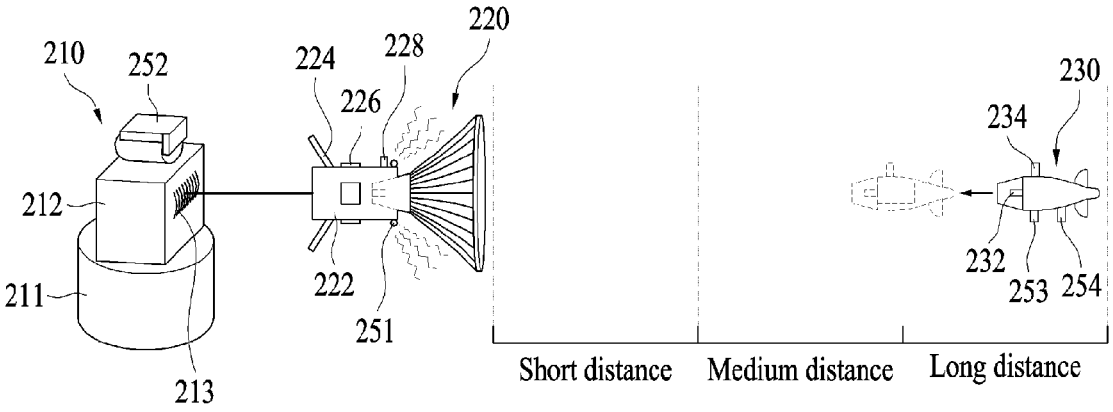
Figure 6D:
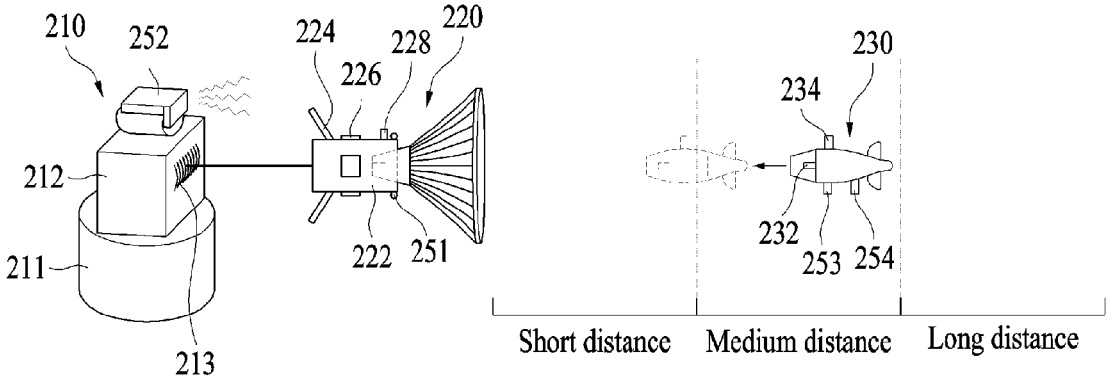
Figure 6E:
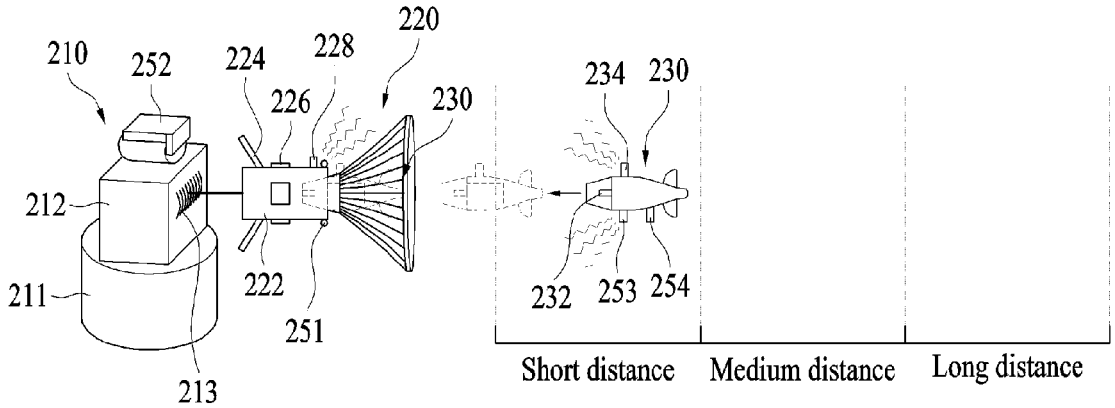

Referring to FIGS. 6*c* and 6*d*, when the target body 230 is within a long distance from the agent unit 220 and thus the ultrasonic beacon 251 generates ultrasonic waves, the target body 230 is roughly guided into a medium distance from the agent unit 220 while the hydrophone of the target body 230 receives the ultrasonic waves. After the target body 230 is guided into the medium distance, the imaging sonar 252 measures in real time distances between the docking station 210, the agent unit 220, and the target body 230 and then transmits a control command to the agent unit 220 through a smart cable 240 to guide the target body 230 to a short distance from the agent unit 220. Thereafter, when the target body 230 enters the short distance from the agent unit 220, the position of the agent unit 220 is checked by the underwater camera provided on the target body 230, and then data about the position of the agent unit 220 is transmitted to the target body 230 by communication units 228 and 234. Thereby, the target body 230 can be connected to the agent unit 220.

As such, the underwater docking system 200 according to this exemplary embodiment of the present invention uses different kinds of guide methods depending on the distance between the target body 230 and the docking station 210 so that the docking operation can be more reliably and precisely conducted.

The imaging sonar 252 is provided on the rotatable body 212 so that the imaging sonar 252 can be always oriented to face the target body 230 by the rotation of the rotatable body 212 relative to the support 211.

After guiding the target body 230 toward the agent unit 220, the agent unit 220 is directly connected with the target body 230. The agent unit 220 is connected to the docking station 210 by the cable 240, whereby after being spaced apart from the docking station 210 by a predetermined distance by the operation of the winch 213, the agent unit 220 can be moored under the water in the direction corresponding to the tidal current.

Unlike the conventional technique in which the target body 230 is directly docked on the docking station 210, the underwater docking system 200 according to this exemplary embodiment of the present invention is configured such that the target body 230 is connected to the separate agent unit 220, which is connected to the docking station 210 by the cable 240 and thus can be moored under the water in the direction corresponding to the tidal current. Therefore, even when a comparatively small docking station 210 and agent unit 220 are used, the influence of the tidal current on the docking operation can be minimized, whereby the docking operation can be conducted more reliably and precisely.

The cable 240 comprises a well-known smart cable to make it possible to transmit data or control signals from the docking station 210 to the agent unit 220 such that the position of the agent unit 220 can be precisely checked in the docking station 210.

In addition, the smart cable is provided with an optical sensor (not shown) so that three-dimensional positions and rotation of both ends of the smart cable can be estimated. Furthermore, a communication line and a power line are installed in the smart cable such that when the target body 230 is docked on the agent unit 220, battery charge and data transmission and reception can be conducted.

Meanwhile, the agent unit 220 includes a main body 222 having a connection port 222*a* on which a connector 232 of the target body 230 is docked, and one or more rudders 224 that are arranged around the circumferential surface of the main body 222.

Thus, when the agent unit 220 is moored by the cable 240 under the water, the agent unit 220 can be oriented in the direction aligned with the tidal current by the rudders 224.

Furthermore, at least one thruster 226 is provided in the main body 222 so that the position of the agent unit 220 that is being moored can be adjusted, whereby the agent unit 220 can overcome hindrance of the tidal current during the docking operation.

Consequently, although the target body 230 that is docked on the agent unit 220 has a torpedo shape that is comparatively long, the target body 230 can more rapidly and precisely approach the agent unit 220 without detouring around a movement path because the location and the direction of the main body 222 can be adjusted by the thruster 226.

The communication units 228 and 234 corresponding to each other are respectively provided in the main body 222 and the target body 230 so that the agent unit 220 and the target body 230 can directly communicate with each other.

That is, the first communication unit 228 is provided in the main body 222 and the second communication unit 234 corresponding to the first communication unit 228 is provided in the target body 230. After the target body 230 has been guided to a position close to the agent unit 220 by the imaging sonar 252, the agent unit 220 and the target body 230 use the communication units 228 and 234 to transmit and receive information about positions relative to each other. Thus, position control and direction control can be precisely conducted, whereby the docking operation can be reliably performed.

Moreover, the communication units 228 and 234 have a function to transmit data and a control signal, which are transmitted from the docking station 210 by the cable 240, to the target body 230 via the agent unit 220.

The target body 230 autonomously moves under the water to collect a variety of information in response to a given assignment. The target body 230 may be an unmanned underwater vehicle or robot such as an autonomous underwater vehicle (AUV) or a remotely operated vehicle (ROV).

After collecting a variety of underwater information, the target body 230 is periodically guided to the agent unit 220 for required maintenance work such as charge of an internal battery and then docked on the connection port 222*a* of the agent unit 220 through the connector 232 provided on a predetermined portion of the target body 230.

The target body 230 may include a separate hydrophone 254 provided to receive a signal transmitted from the ultrasonic beacon 251, and an underwater camera 253 provided to capture an image of the agent unit 220 within the short distance.

Such construction of the target body 230 is well known. Therefore, further explanation is deemed unnecessary.

Meanwhile, as described above, the target body 230 has the second communication unit 234 at a portion thereof to transmit or receive data or a control command to or from the first communication unit 228 of the agent unit 220. Data or a control command transmitted from or to the first communication unit 228 may include information obtained from the hydrophone 254 and the underwater camera 253 that are provided in the target body 230.

Each of the first communication unit 228 and the second communication unit 234 is an LED light source so that data or a signal can be transmitted or received through communication using an optical link. For example, switching on and off the LED light source may be used to transmit required information under the water.

Figure 7:
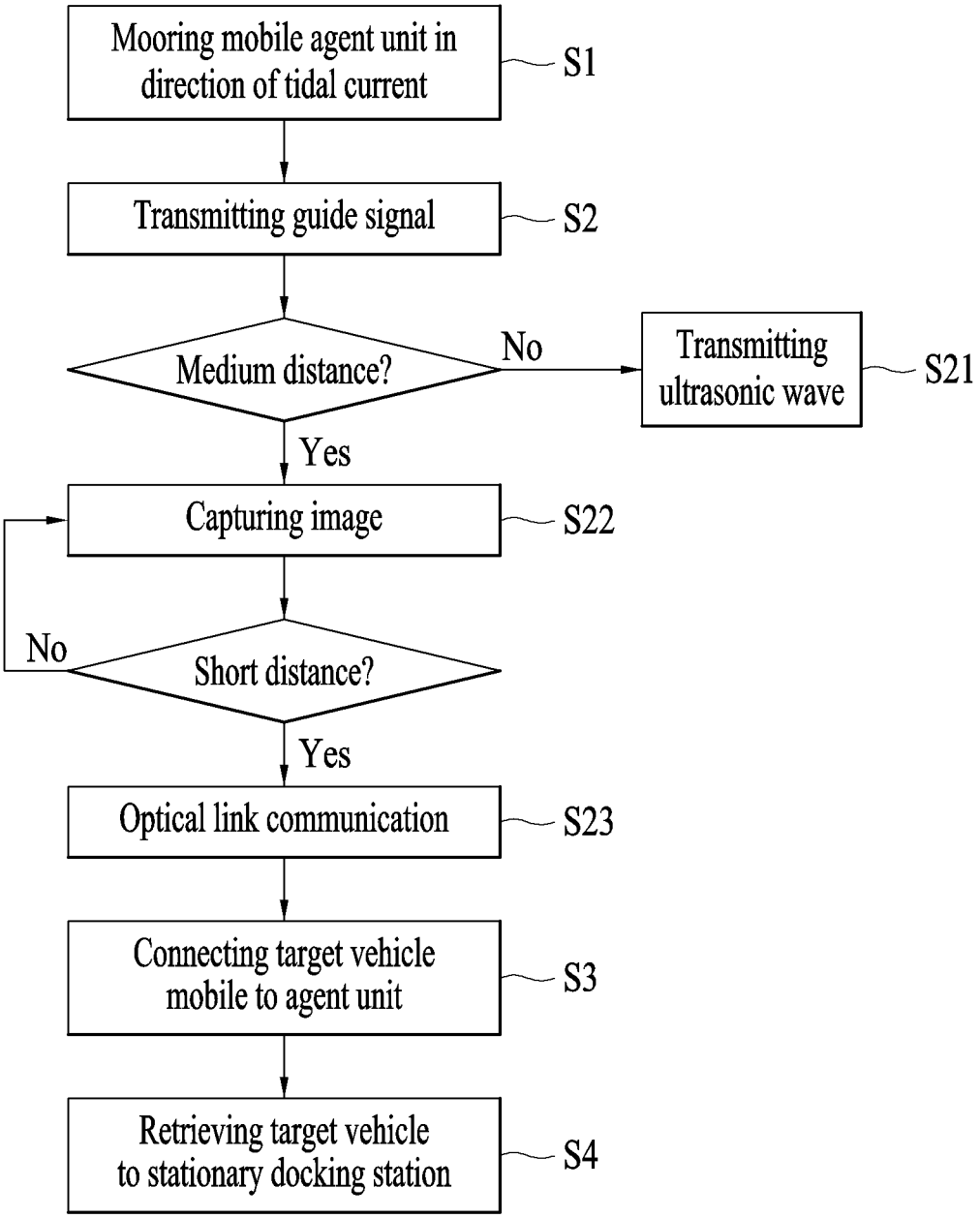
FIG. 7 is a flowchart of an underwater docking method according to an exemplary embodiment of the present invention.

Hereinafter, a method of docking the target body 230 using the underwater mobile agent unit according to an exemplary embodiment of the present invention will be described in detail with reference to FIGS. 6A through 7.

At step S1, the rotatable body 212 with the cable 240 wound around the winch 213 is rotated relative to the support 211 by a predetermined angle so that the agent unit 220 can be located on the tidal path. The winch 213 is thereafter operated to unwind the cable 240 and moor the agent unit 220 at a position spaced apart from the docking station 210 by a predetermined distance. The agent unit 220 is moored in the same direction of that of the tidal current. The rudders 224 provided on the main body 222 are used to maintain the orientation of the agent unit 220.

Subsequently, at step S21, the ultrasonic beacon 251 generates an ultrasonic wave to the target body 230 so as to guide the target body 230 toward the docking station 210 until the target body 230 moves into the medium distance of the docking station 210.

After the target body 230 has moved into the medium distance and thus has approached the docking station 210 or the agent unit 220, at step S22, the distance between the agent unit 220 and the target body 230 is checked using an image captured by the imaging sonar 252, and a control command is transmitted to the agent unit 220 by the cable 240 so that the target body 230 is guided to a position very close to the agent unit 220 in alignment with each other of the agent unit 220 and the target body 230.

During the above operation, the position of the agent unit 220 is adjusted in such a way that the at least one thruster 226 provided on the main body 222 is used to overcome the tidal force.

Meanwhile, during the docking operation, the step S21 of using the ultrasonic beacon 251 to guide the target body 230 can be omitted if the target body 230 is disposed within the medium distance from the agent unit 220.

If the target body 230 very closely approaches the agent unit 220, at step S23, the first communication unit 228 and the second communication unit 234 transmit and receive information about the relative positions via communication so that the target body 230 and the agent unit 220 are aligned with each other. In the meantime, at step S3, the connector 232 of the target body 230 is precisely connected to the connection port 222*a* of the agent unit 220.

Finally, at step S4, after the operation of docking the target body 230 on the agent unit 220 has been completed, the winch 213 is operated to wind the cable 240 around the drum. Consequently, the target body 230 docked on the agent unit 220 is retrieved to the docking station 210.

As described above, in an underwater docking system and a docking method using the system according to an embodiment of the present invention, a target body is docked in such a way that it is connected to an agent unit coupled to a station by a cable and then towed to the station by the agent unit, whereby the target body can be more reliably and effectively retrieved.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A system for docking a target body on a docking station under water, the system comprising:

a guide unit provided to the docking station to transmit at least one guide signal to the target body;

an agent unit connected to the docking station by a cable and disposed at a position spaced apart from the docking station so that the agent unit is moored under the water in a direction corresponding to a tidal current; and the target body configured to be guided toward the agent unit by the guide signal and then connected to a portion of the agent unit;

wherein the docking station is fastened to the seafloor;

wherein the guide unit includes an imaging sonar provided on the docking station capturing an image of the agent unit and the target body when the agent unit and the target body are located in a position corresponding to a second range between the target body and the docking station, the second range is less than a first range between the target body and the docking station;

wherein a distance between the agent unit and the target body is confirmed by the image captured by the imaging sonar; and a control command to align the agent unit and the target body is transmitted to the agent unit by the cable.

2. The system of claim 1, wherein the guide unit comprises:

an ultrasonic beacon generating an ultrasonic wave toward the target body, when the target body is disposed in a position corresponding to the first range from the docking station.

3. The system of claim 1, wherein the cable is connected at a first end thereof to the agent unit and connected at a second end thereof to a winch of the docking station so that a distance between the docking station and the agent unit is varied by operation of the winch.

4. The system of claim 3, wherein the agent unit comprises:

a main body provided with a connection port on which a connector of the target body is docked;

at least one rudder provided on a circumferential surface of the main body; and at least a propeller provided on the main body so that a position at which the agent unit is moored can be adjusted.

5. The system of claim 4, wherein the main body and the target body respectively comprise communication units corresponding to each other, the communication units sending and receiving a control signal transmitted by the cable so that a position of the target body is adjusted.

6. The system of claim 1, wherein the cable is a smart cable configured to transmit data or signals from the docking station to the agent unit.

7. A system for docking a target body on a docking station under water, the system comprising:

a docking station;

an agent unit connected to the docking station by a cable and disposed at a position spaced apart from the docking station so that the agent unit is moored under the water in a direction corresponding to a tidal current;

a guide unit provided to the docking station to transmit a guide signal to the target body; and the target body configured to be guided toward the agent unit by the guide signal and then connected to the agent unit;

wherein the docking station is fastened to the seafloor;

wherein the guide unit includes an imaging sonar provided on the docking station capturing an image of the agent unit and the target body when the agent unit and the target body are located in a position corresponding to a second range between the target body and the docking station, the second range is less than a first range between the target body and the docking station;

wherein a distance between the agent unit and the target body is confirmed by the image captured by the imaging sonar; and a control command to align the agent unit and the target body is transmitted to the agent unit by the cable.

8. The system of claim 7, wherein the guide unit comprises:

an ultrasonic beacon generating ultrasonic waves toward the target body when the target body is disposed in a position corresponding to the first range, and thus guiding the target body into a position corresponding to the second range;

an imaging sonar measuring the distance between the agent unit and the target body guided into the position corresponding to the second range and then guiding the target body from the position corresponding to the second range into a position corresponding to a third range; and an underwater camera provided on the target body to check the position of the agent unit, when the target body is guided to a position corresponding to a third range between the target body and the docking station for guiding the target body to the agent unit, the third range is less than the second range.

9. The system of claim 8, wherein, the ultrasonic beacon is provided on the agent unit and the underwater camera is provided on the target body.

10. The system of claim 7, wherein the cable is connected at a first end thereof to the agent unit and connected at a second end thereof to a winch of the docking station so that a distance between the docking station and the agent unit is varied by operation of the winch.

11. The system of claim 7, wherein the agent unit comprises:

a main body provided with a connection port on which a connector of the target body is docked; and at least one rudder provided on a circumferential surface of the main body.

12. The system of claim 11, wherein the main body is provided with at least a propeller so that a position at which the agent unit is moored can be adjusted.

13. The system of claim 11, wherein the main body and the target body respectively comprise communication units corresponding to each other, the communication units sending and receiving a control signal transmitted by the cable so that a position of the target body is adjusted.

14. The system of claim 7, wherein the docking station comprises:

a support fixed at a lower end thereof in the water; and a rotatable body provided on an upper portion of the support so as to be rotatable relative to the support.

15. The system of claim 7, wherein the cable is a smart cable configured to transmit data or signals from the docking station to the agent unit.

16. A method of docking a target body on a docking station under water, the method comprising:

mooring an agent unit for docking the target body on the docking station by a cable and disposed at a position spaced apart from the docking station in a direction of a tidal current, transmitting a guide signal from a guide unit provided in the docking station to the target body; and connecting the target body guided toward the agent unit by the guide signal to the agent unit;

capturing an image of the agent unit and the target body with an imaging sonar of the guide unit, the imaging sonar is provided on the docking station;

confirming the distance between the agent unit and the target body with the image captured by the imaging sonar; and transmitting a control command to align the agent unit and the target body with the cable.

17. The method of claim 16, wherein the guide unit comprises an ultrasonic beacon generating an ultrasonic wave, an imaging sonar capturing an image, and an underwater camera checking the position of the agent unit;

wherein the target body is guided toward the docking station by the ultrasonic wave when the target body is disposed in a position corresponding to a first range from the docking station, the target body is guided toward the agent unit using an image captured by the imaging sonar when the target body is disposed in a position corresponding to a second range from the docking station, and the target body is guided toward the agent unit using the underwater camera when the target body is disposed in a position corresponding to a third range from the docking station.

18. The method of claim 17, wherein the agent unit and the target body respectively comprise communication units corresponding to each other, the communication units sending and receiving a control signal and an information regarding the position of the agent unit captured by a underwater camera so that a position of the target body is adjusted.

19. The method of claim 16, wherein a position at which the agent unit is moored is adjusted in such a way that a length of the cable connected at a first end thereof to the agent unit and connected at a second end thereof to a winch of the docking station is varied by operation of the winch.

20. The method of claim 16, wherein the agent unit comprises:

a main body provided with a connection port on which a connector of the target body is docked, and at least one propeller provided on a circumferential surface of the main body, wherein a position at which the agent unit is moored is adjusted by operation of the propeller.

21. The method of claim 16, wherein the docking station comprises a support fixed at a lower end thereof in the water, and a rotatable body rotatably coupled to the support, wherein the rotatable body is rotated such that the agent unit is aligned with the direction of the tidal current.

22. The system of claim 16, wherein the cable is a smart cable configured to transmit data or signals from the docking station to the agent unit.

* * * * *